United States Patent [19]

Freeman et al.

[11] Patent Number: 4,919,206

[45] Date of Patent: Apr. 24, 1990

[54] METHOD FOR PREVENTING BITUMEN BACKFLOW IN INJECTION WELLS WHEN STEAM INJECTION IS INTERRUPTED

[75] Inventors: D. C. Freeman, Dallas; N. F. Djabbarah, Richardson, both of Tex.

[73] Assignee: Mobil Oil Corporation, New York, N.Y.

[21] Appl. No.: 381,930

[22] Filed: Jul. 19, 1989

[51] Int. Cl.[5] ..... E21B 43/24; E21B 47/06

[52] U.S. Cl. ..... 166/252; 166/272; 166/303

[58] Field of Search ..... 166/250, 252, 272, 263, 166/303, 370

[56] References Cited

U.S. PATENT DOCUMENTS

| | | | |
|---|---|---|---|
| 3,396,791 | 8/1968 | Van Meurs et al. | 166/272 |
| 3,460,621 | 8/1969 | Gum et al. | 166/272 X |
| 3,682,244 | 8/1972 | Bowman | 166/272 X |
| 4,060,129 | 11/1977 | Gomaa et al. | 166/252 |
| 4,522,263 | 6/1985 | Hopkins et al. | 166/272 |
| 4,620,592 | 11/1986 | Perkins | 166/272 X |
| 4,821,564 | 4/1989 | Pearson et al. | 73/155 |

*Primary Examiner*—Stephen J. Novosad
*Attorney, Agent, or Firm*—Alexander J. McKillop; Charles J. Speciale; Charles A. Malone

[57] ABSTRACT

A steam flood operation in which each injector is fitted with a pressure transducer and control valve which are tied into a water supply. Upon a loss of steam injection, and injection pressure, the pressure transducer signals the control valve and a pump actuator so as to cause water injection to take place and thus prevent heavy oil containing bitumen or bitumen backflow.

20 Claims, 1 Drawing Sheet

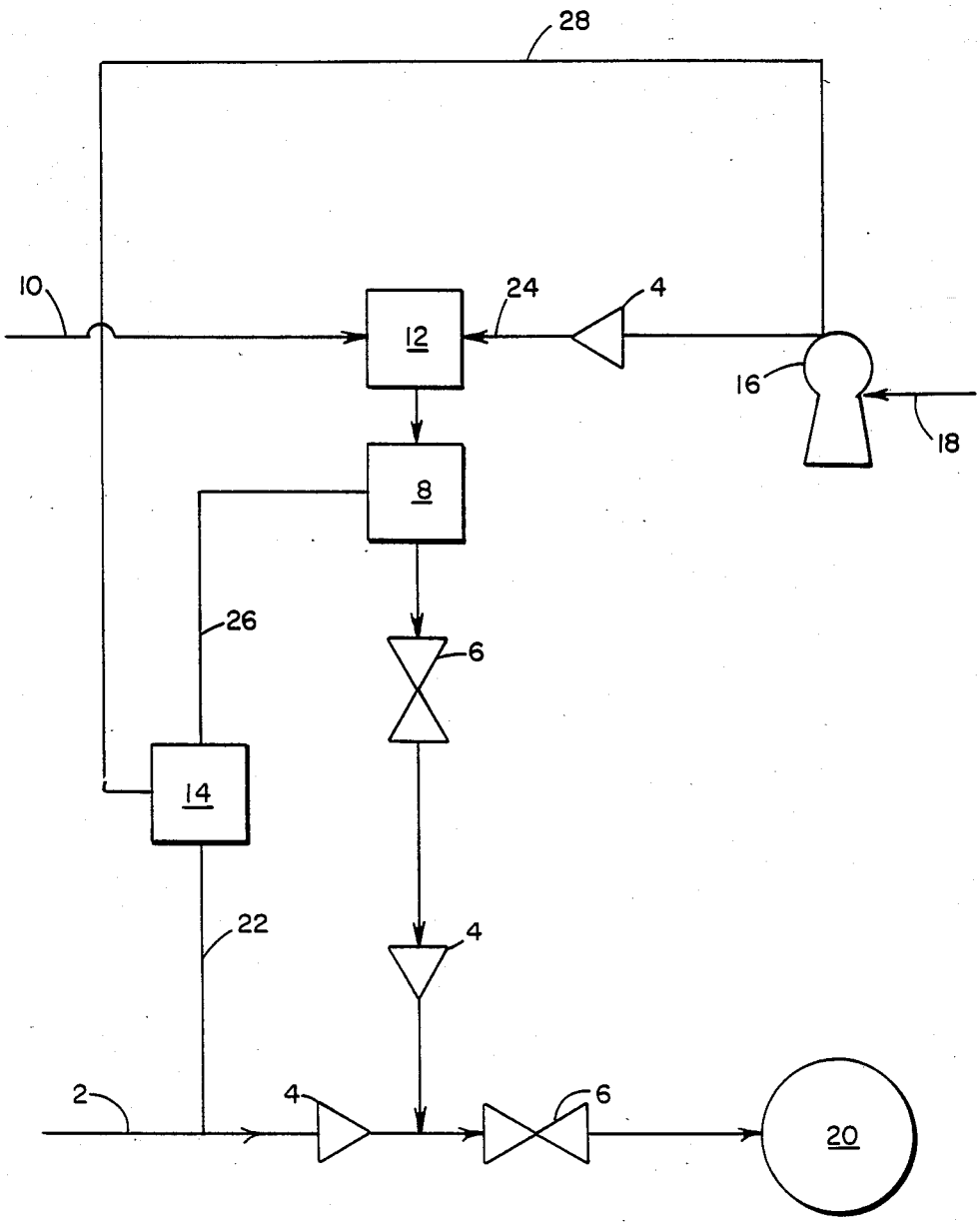
28
10
24
4
12
16
18
8
26
6
14
22
4
2
4
6
20

METHOD FOR PREVENTING BITUMEN BACKFLOW IN INJECTION WELLS WHEN STEAM INJECTION IS INTERRUPTED

FIELD OF THE INVENTION

This invention concerns a steam drive oil recovery method wherein steam is used to recover viscous oil from an underground formation. More specifically, it is directed to a method for preventing the plugging of a well during an interrupted steam injection operation.

BACKGROUND OF THE INVENTION

Steam has been used in many different methods for the recovery of oil from subterranean, viscous oil-containing formations. There are many subterranean petroleum-containing formations in various parts of the world from which petroleum cannot be recovered by conventional means because the petroleum is too viscous to flow or to be pumped. The most extreme examples of viscous petroleum-containing formations are the so-called tar sand or bitumenous sand deposits. The largest and most famous such formation is the Athabasca Tar Sand Deposit in the northeastern part of the province of Alberta, Canada, which contains over 700,000,000 barrels of petroleum. Other extensive deposits are known to exist in the western United States and Venezuela, and smaller deposits exist in Europe and Asia.

The two most basic processes used for recovering viscous oil from a formation includes a "steam drive" process and a "huff and puff" steam process. Steam drive involves injecting steam through an injection well into a formation. Upon entering the formation, the heat transferred to the formation by the steam lowers the viscosity of the formation oil, thereby improving its mobility. In addition, the continued injection of steam provides a drive to displace oil toward a production well from which it is produced. Huff and puff involves injecting steam into a formation through a well, stopping the injection of steam, permitting the formation to soak and then producing oil through the original well.

Steam flooding operations for recovering heavy oil utilizing propane- or diesel-fired downhole steam generators are described in "Steam Generators Work Long Periods Downhole", Oil and Gas Journal, July 5, 1982, pp. 76 and 78, and "West Coast EOR Project Results Discouraging", Oil and Gas Journal, Aug. 9, 1982, pp. 82.

During steam flooding of a viscous oil containing formation or a formation-containing solid bitumen, occasionally steam flooding is interrupted. Viscous oil or solid bitumen becomes mobile at the elevated temperatures existing in a steamflood. When steam injection is interrupted, heavy oil containing bitumen or bitumen may enter the casing through the perforations, flow upwardly, cool, and solidify. This results in reduced or steam injectivity cessation which causes costly workovers and occasionally leads to complete well failures.

Therefore, what is needed is a method to prevent oil containing bitumen or bitumen from backflowing into the well and solidifying when steam injection is interrupted so as to prevent costly workovers and avoid complete well failures.

SUMMARY OF THE INVENTION

This invention is directed to a method for preventing viscous hydrocarbons fluids containing bitumen or bitumen from backflowing into a well upon interruption of a steam flooding process. In the practice of this invention a substantial reduction in steam injection pressure in at least one injection well is detected via a pressure sensing device. This pressure sensing device sends a signal to a control valve and water pump actuator. Since the control valve is opened and the pump is actuated, water under pressure is injected into the injection well in response to the reduction in steam pressure. The water is injected at a pressure sufficient to prevent viscous hydrocarbonaceous fluids containing bitumen or bitumen from backflowing into the injection well. Stopping hydrocarbonaceous fluids from backflowing into the injection well during a loss of steam injectivity prevents plugging the well, thereby avoiding costly workovers and complete well failures. Interruption of steam injectivity may be caused by, e.g., loss of electrical power, loss of a steam heating means, or loss of a water supply.

It is therefore an object of this invention to provide a method for preventing viscous oil or bitumen backflow into an injection well when steam interruption occurs.

It is another object of this invention to provide a simple economical means for preventing viscous oil or bitumen backflow into a well to avoid steam injectivity interruption or costly well workovers.

It is yet another object of this invention to avoid the backflow of viscous oil or bitumen into an injection well so as to prevent well failures.

BRIEF DESCRIPTION OF THE DRAWING

The drawing is a schematic representation of the method of the instant invention whereby bitumen or heavy oil backflow into a wellbore is prevented during the interruption of a steam flooding process.

BRIEF DESCRIPTION OF THE PREFERRED EMBODIMENT

In the practice of this invention as is shown in the drawing, steam enters wellhead or well 20 via line 2. Check valves 4 prevent steam or another fluid from flowing into any direction other than to wellbore 20 through bean valve 6. Steam is continuously injected into wellbore 20 to recover viscous hydrocarbonaceous fluids from the formation. A steam drive oil recovery method which can be utilized herein for recovering viscous hydrocarbonaceous fluids from a reservoir is disclosed in U.S. Pat. No. 4,522,263 which issued to Hopkins et al. on June 11, 1985. This patent is incorporated by reference herein. Steam injection into wellbore 20 continues until such time as steam interruption occurs. Steam interruption may be caused e.g., by a power failure, loss of water production capacity, or loss of the capacity to deliver steam to the wellbore.

Steam pressure going into wellbore 20 via line 2 is also directed to pressure transducer 14. As long as steam injection pressure is going into wellbore 20, pressure transducer 14 sends a signal via line 26 to control valve 8 thereby keeping it closed. When a steam interruption occurs, steam injection pressure on line 2 drops causing the pressure drop to be sent to pressure transducer 14 via line 22. Subsequently, pressure transducer 14 signals control valve 8 to open. A pressure transducer which can be utilized herein is sold by Validyne Engineering Corp., located in North Ridge, CA. Use of pressure transducer in a method and system for determining fluid pressures in wellbores and tubular conduits is discussed in U.S. Pat. No. 4,821,564 which issued to Pearson et al. on Apr. 18, 1989. This patent is hereby incorporated by reference herein.

While pressure transducer 14 is signaling control valve 8 to open, it also sends a signal via line 28 to pump 16 which is connected to pressurized water line 18. Once pump 16 is actuated, water is transmitted through line 24 into gas-liquid mixer 12 where it proceeds through control valve 8 down through bean valve 6. Afterwards water enters line 2 and is injected into wellbore 20. Check valves 4 keep water from backflowing into line 24 from wellbore 20. Water is thereafter injected into wellbore 20 under a pressure sufficient to prevent viscous heavy oil containing bitumen or bitumen from backflowing into steam injection line 2. After steam injection pressure has been restored, steam injection again is commenced via line 2 into wellbore 20. Once increased steam pressure is sensed by pressure transducer 14, it signals control valve 8 to close. Similarly, pressure transducer 14 signals pump 16 to cease pumping water. Thus, steam injection is restored into wellbore 20 and water injection is ceased. Necessary power for pump 16 is obtained preferably from a source independent from that which is used for injecting steam into wellbore 20. As will be understood by those skilled in the art, water is injected at a rate sufficient to maintain a downhole pressure comparable to that existing during normal steam injection operations.

In another embodiment of this invention, a surfactant which emulsifies bitumen or viscous heavy oil containing bitumen may be added to the water which is injected into the wellbore. The purpose of this surfactant is to clean the reservoir near injection well 20. As is preferred, about 1 to about 2 wt.% of RBS-35 surfactant can be utilized when injecting water. RBS-35 is a trade name of a surfactant which is marketed by Pierce Chemical Co. which is located in Rockford, Ill. This surfactant is sufficient to emulsify 13 API crude oil containing about 20 wt.% bitumen.

In another embodiment, pressure maintenance at wellbore 20 is accelerated by co-injecting a gas along with the water. A preferred gas for use herein is nitrogen. In this embodiment, nitrogen is injected via line 10 into gas-liquid mixer 12 during the injection of water into wellbore 20. In this embodiment, nitrogen is injected into gas-liquid mixer 12 by having nitrogen pressure constantly on line 10. Alternatively, nitrogen pressure can be controlled by a valve means so as to allow nitrogen to enter line 10 upon receiving a signal from pressure transducer 14. In both embodiments, line 10 leading to gas-liquid mixer 12 is connected to a compressed nitrogen tank.

In yet another embodiment, pressurized gas can be used in combination with a surfactant which has been placed into the water to obtain both a cleaning and a pressure maintenance function in wellbore 20. Gas under pressure is injected via line 10 into gas-liquid mixer 12 while water containing a surfactant is injected into gas-liquid mixer 12 by line 24 via pump 16. Pressurized gas and water containing the surfactant flow together through control valve 8 and check valve 4 into line 2 where it subsequently enters the formation via wellbore 20.

Obviously, many other variations and modifications of this invention as previously set forth may be made without departing from the spirit and scope of this invention as those skilled in the art readily understand. Such variations and modifications are considered part of this invention and within the purview and scope of the appended claims.

What is claimed is:

1. A method for preventing viscous hydrocarbonaceous fluids from backflowing into a well upon interruption of a steamflood comprising:

(a) detecting a substantial reduction in steam injection pressure in at least one injection well via a pressure sensing device; and (b) causing automatically a pressurized fluid to be injected into said injection well in response to the reduction in pressure which prevents viscous hydrocarbonaceous fluids from backflowing into the injection well.

2. The method as recited in claim 1 where the pressure sensing device is a pressure transducer.

3. The method as recited in claim 1 where the pressure sensing device is a pressure transducer which signals a control valve to open and which also starts a pump which pumps pressurized water into the injection well.

4. The method as recited in claim 1 where an auxiliary power source is used to cause the pressurized fluid to be directed into the injection well.

5. The method as recited in claim 1 where the fluid injected into said well is water which is injected at a rate sufficient to maintain a downhole pressure comparable to that existing during a normal steam injection operation.

6. The method as recited in claim 1 where in step (b) the fluid comprises water which contains a surfactant that emulsifies bitumen.

7. The method as recited in claim 1 where the fluid is water which is pressurized by coinjecting pressurized gas with the water.

8. The method as recited in claim 1 where in step (b) the fluid comprises water which contains a surfactant which emulsifies bitumen and where the water is pressurized by coinjecting pressurized gas therewith.

9. The method as recited in claim 1 where in step (b) the fluid comprises water which contains a surfactant which emulsifies bitumen and where the water is pressurized by injecting pressurized nitrogen therewith.

10. A method for preventing viscous hydrocarbonaceous fluids from backflowing into a well upon interruption of a steamflood comprising:

(a) detecting a predetermined reduction in at least one injection well via a pressure transducer; and (b) causing automatically pressurized water to be injected into said injection well in response to the reduction in pressure which prevents viscous hydrocarbonaceous fluids from backflowing into the injection well.

11. The method as recited in claim 10 where an auxiliary electrical power source is used to start a pump which injects said water into the injection well.

12. The method as recited in claim 10 where said pressure transducer signals a control valve to close and a pump to stop pumping water when steam injection is again commenced so as to cease water injection.

13. The method as recited in claim 10 where the water is injected at a rate sufficient to maintain a downhole pressure comparable to that existing during a steamflood.

14. The method as recited in claim 10 where in step (b) said water contains a surfactant that emulsifies bitumen and cleans an area adjacent to said wellbore.

15. The method as recited in claim 10 where in step (b) said water contains a surfactant which emulsifies bitumen while compressed nitrogen maintains pressure in the wellbore while accelerating the injection of water.

16. A method for preventing viscous hydrocarbonaceous fluids containing bitumen from backflowing into a well upon interruption of a steamflood comprising:

(a) detecting a predetermined reduction in at least one injection well via a pressure transducer; and (b) causing automatically pressurized water to be injected in said injection well, along with pressurized nitrogen gas, in response to the reduction in pressure which prevents viscous hydrocarbonaceous fluids from backflowing into the injection well.

17. The method as recited in claim 16 where an auxiliary electrical power source is used to start a pump which injects said water into the injection well.

18. The method as recited in claim 16 where said pressure transducer signals a control valve to close and a pump to stop pumping water when steam injection is again commenced so as to cease water injection.

19. The method as recited in claim 16 where the water is injected at a rate sufficient to maintain a downhole pressure comparable to that existing during a steamflood.

20. The method as recited in claim 16 where in step (b) said water contains a surfactant that emulsifies bitumen and cleans an area adjacent to said wellbore.

* * * * *